United States Patent [19]

Reichman

[11] Patent Number: 4,624,327

[45] Date of Patent: Nov. 25, 1986

[54] METHOD FOR COMBINED JET AND MECHANICAL DRILLING

[75] Inventor: James R. Reichman, Issaquah, Wash.

[73] Assignee: Flowdril Corporation, Kent, Wash.

[21] Appl. No.: 661,368

[22] Filed: Oct. 16, 1984

[51] Int. Cl.[4] ..... E21B 7/18

[52] U.S. Cl. ..... 175/67; 175/70

[58] Field of Search ..... 175/65, 66, 67, 70, 175/38, 207, 209, 215, 217, 218; 299/16, 17

[56] References Cited

U.S. PATENT DOCUMENTS

| | | | |
|---|---|---|---|
| 1,338,460 | 4/1920 | Morrison . | |
| 1,512,140 | 10/1924 | Schaub . | |
| 1,585,969 | 5/1926 | Ferguson | 175/70 |
| 2,258,001 | 10/1941 | Chamberlain | 255/1 |
| 2,720,381 | 10/1955 | Quick | 255/1.8 |
| 2,941,783 | 6/1960 | Stinson | 175/66 X |
| 3,112,800 | 12/1963 | Bobo | 175/67 |
| 3,375,886 | 4/1968 | Goodwin | 175/66 |
| 3,508,621 | 4/1970 | Gaylord | 175/67 |
| 3,839,875 | 10/1974 | Matsushita | 61/53.75 |
| 3,851,490 | 12/1974 | Matsushita | 61/53.74 |
| 4,359,115 | 11/1982 | Cagnioncle | 175/67 X |
| 4,458,766 | 7/1984 | Siegel | 175/25 |
| 4,534,427 | 8/1985 | Wang et al. | 175/67 |

FOREIGN PATENT DOCUMENTS

| | | | |
|---|---|---|---|
| 933146 | 9/1973 | Canada | 175/65 |

OTHER PUBLICATIONS

"Evaluation of High Pressure Drilling Fluid Supply Systems", Flow Technology Report No. 195, Jun., 1981.

"Research and Development of a High Pressure Water Jet Coring Device for Geothermal Exploration and Drilling", Flow Technology Report No. 106, Jan., 1978, James M. Reichman.

"Tests Show Jet Drilling Has Promise", *Oil and Gas Journal,* Jul. 1974, R. Feenstra et al., pp. 45–57.

"High Pressure Drilling", *Journal of Petroleum Technology,* Jul. 1973, William C. Maurer et al., pp. 851–859.

*Primary Examiner*—Stuart S. Levy

*Assistant Examiner*—Thomas R. Hannon

*Attorney, Agent, or Firm*—Knobbe, Martens, Olson & Bear; Knobbe, Martens, Olson & Bear

[57] ABSTRACT

A method and apparatus for drilling combines the advantages of a high pressure fluid jet with a mechanical drill bit without the high horsepower requirements and associated equipment wear of prior jet drilling systems. A two fluid system is contemplated in which only a small portion of the drilling mud stream is clarified and pumped under high pressure to a number of jet nozzles located on the drill bit face. The high pressure fluid and concentrated drilling mud are conducted separately down the hole by a dual, concentric drill pipe. The power and equipment requirements of such a two fluid system are practical and economic because of the low flow rate and non-abrasiveness of the high pressure fluid when compared to conventional drilling fluids. The high pressure fluid combines with the concentrated drilling mud at the drill bit in order to accomplish the normal purposes of the drilling mud. The returned fluid is processed at the surface separating out solids, mud, and the mud to be clarified. This forms a closed system cycle. The fluid jets are strategically arranged with respect to the cutting teeth on the drill bit in order to minimize bit wear and to increase the drilling rate by up to five times. Two systems are disclosed. The first is a jet assisted mechanical system in which the jets are directed at the earthen formation at the cutting surface/rock interface. The second is a mechanically assisted jet system in which the jets are located between the cutting teeth.

23 Claims, 5 Drawing Figures

Fig. 2
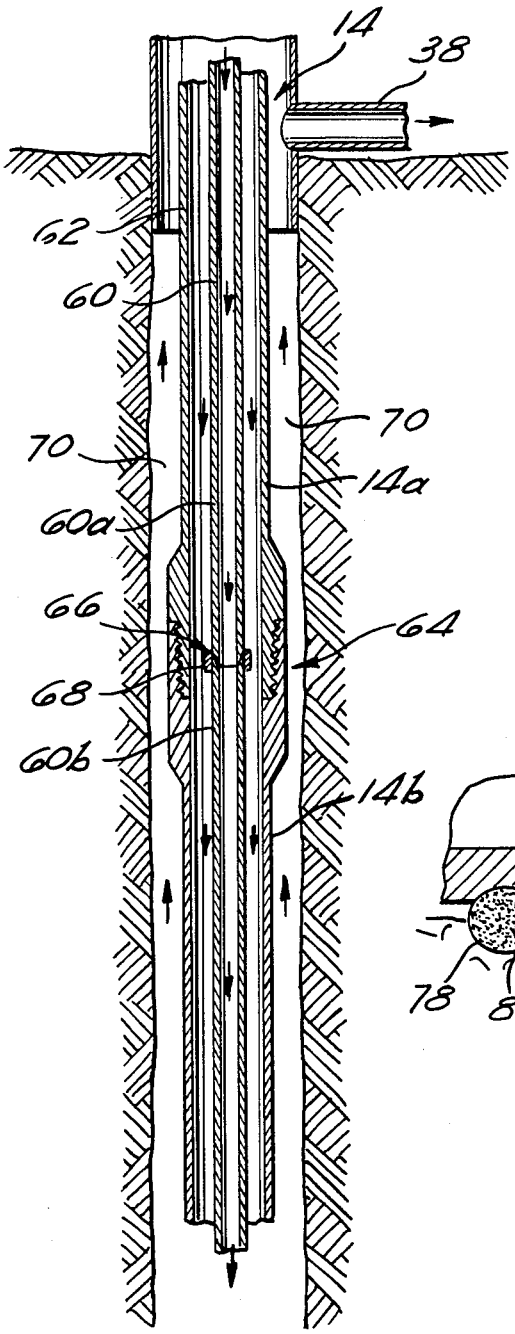
Fig. 4
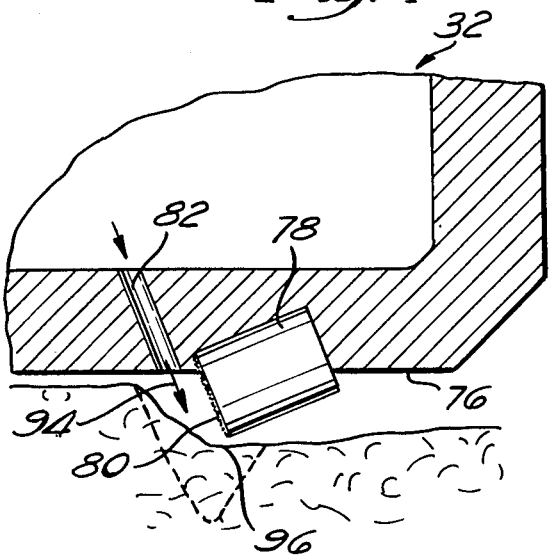
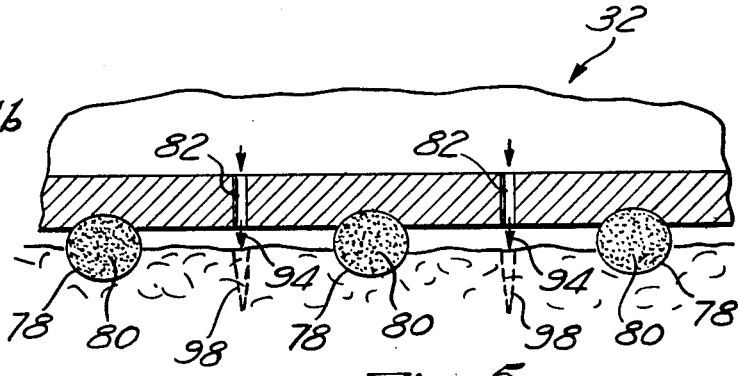
Fig. 5

METHOD FOR COMBINED JET AND MECHANICAL DRILLING

BACKGROUND OF THE INVENTION

The present invention relates to a method and apparatus for drilling in earthen formations for the production of gas, oil, and water. The system is also useful in mining operations and anywhere it is necessary to drill a hole of a particular diameter into the earth. In particular, the present invention relates to a method and apparatus for fluid jet-assisted mechanical drilling or mechanically-assisted fluid jet drilling. Although the invention is described herein in connection with gas and oil well drilling, the principles and concepts disclosed apply equally to other forms of drilling.

In oil and gas well drilling, the cost of equipment and labor is extremely high. In order to minimize the cost of this phase of oil and gas production, it is desirable to drill the holes through earthen formations, as rapidly as possible commensurate with good drilling practices. In drilling earthen formation holes, particularly in harder formations (which are more difficult to drill) and as the depth of the hole increases, there are a number of operating problems that tend to make the cost of such holes more expensive. Also, there are a number of tradeoffs and drilling factors which must be considered in order to maximize the rate of penetration of the drill bit and minimize the cost.

The primary sources of drilling forces which affect the rate of penetration during drilling are: (1) the torque provided by the rotation of the drill bit as it bores its way through the earthen formation, (2) the weight, supplied by that portion of the drill assembly known as the drill collar, acting on the drill as it presses against the formation, and (3) the pressure of the drilling fluid which is delivered to the drill bit through the drill string.

As the depth of the well increases, the drilling forces available to the drill bit as a result of the rotation of the drill bit and the pressure of the drilling mud are reduced because of transmission losses between the drilling rig and the bit. Furthermore, as the hole gets deeper, the earthen formations become more difficult to drill. Therefore, the rate of penetration decreases.

To maintain the rate of penetration the weight acting on the drill bit and its torque can be increased. However, where the weight on the drill bit is increased, the drill bit wears out much faster. It then becomes necessary to replace the drill bit more frequently. This is also a very undesirable trade-off since the entire drill string must be removed from the hole in order to replace the drill bit. For holes of 10,000 feet or more, replacing the bit often takes one or more days and is very costly.

Placing additional weight on the drill bit is also an undesirable trade-off because increased weight causes the bit to drill in unwanted directions (directional instability), which may cause expensive operating problems.

High pressure fluid jets provide a means of increasing the rate of penetration by increasing power levels at the bit without increasing directional control requirements. There are methods in current practice that use fluid jets to increase drilling rates. These methods involve increasing the fluid pressure of the conventional drilling mud stream from 2000 pounds per square inch (psi) to approximately 4000 psi. The added pressure is used to increase the velocity of the fluid leaving the nozzles. However, this is done only to assist in the removal of the cuttings, not to penetrate the rock. This method is commonly known as jet drilling and generally results in increased rates of penetration of about 30% to 50% over conventional approaches.

Experimental approaches have investigated higher pressure fluid jets as a means to assist the drilling process by actually cutting the rock with the jet. In one program in which target pressures of 15,000 psi were attempted, the rates of penetration increased by factors of 2 to 4 but apparently the system held together only for a short time duration. The system was designed to increase the entire mud stream pressures from pump through jet nozzles. This required surface power sources of around 5000 horsepower (hp) at mud flow rates of about 400 gallons per minute (gpm). Numerous operating problems ensued because of elevated pressures. Both pump and transmission systems (drilling assembly) failed in a relatively short time. The approach was proven to be technically effective, but not practical.

SUMMARY OF THE INVENTION

The present invention comprises a drilling method and apparatus which achieves the advantages of jet drilling without the attendant disadvantages. This invention comprises a hybrid system which couples the advantageous effects of a fluid jet and a mechanical drill bit in a dual-fluid system. The resulting combined jet and mechanical drill provides a dramatic increase (up to five times) in the drilling rates available with conventional techniques, without increasing the weight acting on the drill bit or experiencing the related directional control problems.

The methodology of this invention, to solve the problems encountered by the earlier experimenters, is to separate the power stream used for drilling from the end stream used for removing cuttings from the bore hole. The process takes a relatively small side stream from the total mud stream, raises it to much higher pressure, e.g., 20,000 psi or higher, transmits it via a dual conduit drilling assembly to a drill bit modified with a series of small nozzles, and recombine the two fluid streams at the bottom of the hole to form a conventional drilling fluid that is circulated back to the surface to repeat the cycle. As a result, a low horsepower, (for example, approximately 600 hp compared to 5000 hp when the entire mud stream is pressurized) highly effective jet power stream is provided at the bit that adds drilling capacity at the bottom of the hole and increases the rates of penetration by a factor of 5 or more over conventional systems.

The drilling mud, containing the rock chips and debris, is filtered at the top of the well in the normal process. The side stream portion is filtered even further for use as a high pressure fluid. It may be necessary to clarify the side stream by decreasing suspended solids content and eliminating particle sizes larger than, for example, 300 microns. As an alternative to filtered or clarified drilling mud, any fluid that the high pressure pumps can handle without excessive wear and tear, and that won't plug the nozzle at the drill bit, can be utilized as the high pressure fluid.

Thus, the present method and system comprises a closed system in which the drilling fluid, including mud and high pressure fluid, continuously circulate. Because these two fluids mix at the drill bit, the drilling mud may be concentrated so that the final solution contains the proper additives for those particular drilling conditions. This drilling mud concentration is accomplished at the surface where the additives are added to the mud before it is pumped down the drill pipe.

The volume of the high pressure fluid under the system of the present invention is much less than the total drilling mud volume as in prior art jet drilling systems. The volume of the high pressure fluid is on the order of 25–75 gpm as opposed to 300–400 gpm for the total drilling mud stream. In addition, the high pressure of the jet fluid (for example, on the order of 15,000–25,000 psi or even higher) can be achieved at these lower volumes by means of only 200–900 hp. This compares with 3,000–6,000 hp under prior systems. Thus, there is a significant reduction in the horsepower requirements for jet cutting by the present drilling system. Because of this tremendous reduction in horsepower, even higher pressures, such as 40,000–50,000 psi, can be achieved in the jet fluid without uneconomical horsepower requirements when low flow rates are maintained.

There are several other associated advantages of the present drilling method. Because the high pressure fluid is filtered or clarified such that the abrasives and mud additives are reduced, there is minimal abrasion and wear on the pumping equipment and the drill string conduits. Furthermore, because of the lower flow rates and the positioning of the jet nozzles with respect to the drilling bit, there is no overcut. This aids in maintaining good hole straightness. Moreover, the concentric conduit, having the high pressure fluid within the outer, drilling mud fluid, minimizes any safety hazards associated with the high pressures of the fluid jet.

Because low volume - high pressure systems are safer than high volume - high pressure systems, and because the use of a concentric dual conduit drilling assembly puts the high pressure - low volume power stream inside of a conduit which in turn is inside of regular drill pipe, further increasing safety, the jet drilling system herein described is able to meet the demand for a safe, economical method that will increase rates of penetration at depth and in hard to drill earthen formations.

The present method and apparatus is also highly advantageous because it can be easily integrated into conventional drilling systems. Moreover, conventional drilling can be continued without bit replacement should softer formations be encountered. Also, because the rate of penetration for the present method is so high, the delays and high expense associated with "fishing" may be eliminated. Fishing occurs when an object is lost at the bottom of the well and must be retrieved before drilling can continue. With the higher drilling rates achieved under the present system, the obstruction potentially can be drilled around or a new hole drilled with economic results.

Furthermore, under the present system, controlled directional drilling is faster. This is because the gravitational force component supplied to the conventional drill bit by the weight of the drill string decreases since gravity is no longer acting directly in line with the direction of the bit. Power levels to the bit are further reduced by the increased friction of the drill pipe and drill collar as it lays against the side of the hole. Because increases in power level are supplied, in the present invention, by high pressure fluid which is not affected by the change in hole direction, the present invention produces faster directional hole drilling than conventional approaches.

The present invention also contemplates an improved drill bit system. In prior jet drilling systems, the fluid jet acted on the rock independent of the mechanical cutter. In the present invention, however, the fluid jet acts in concert with the mechanical cutter. Two mechanisms are proposed.

In the first mechanism, a jet assisted mechanical system, the fluid jet is configured with respect to each cutting tooth so that the jet is parallel and close to the cutting plane of the tooth and strikes the earthen formation at the cutting surface/rock interface. Thus, the fluid jet serves the important function of cleaning the surface of the rock so that the cutting tooth can avoid crushing cut rock and efficiently apply the cutting force. With conventional drilling methods, more than 75% of the cutting power is used up in crushing chips and rocks which have already been cut. This expenditure of power is wasteful and reduces the drilling rate. By the use of a fluid jet aimed at the cutter/rock interface, previously cut rock is cleaned from the cutter, thus providing direct contact between the formation and the drill bit, thereby vastly increasing the drilling rate.

An important advantage of the present fluid jet/mechanical drill bit is that the cutter forms cracks which may be propagated by the water jet. In particular, the fluid jet improves drilling in ductile failure conditions by encouraging the formations of cracks in the rock. This reduces pressure and horsepower requirements and improves bit life at the same time.

In accomplishing these advantages, the distance between the fluid jet and the substantially parallel cutting to the plane is approximately 0.5–3 millimeters and is located approximately 5 to 50 millimeters from the desired target. It should also be noted that a submerged jet is involved in this invention since the drilling mud surrounds the cutting environment. It has been found that any power loss in the fluid jet due to its submerged state is due more to the dispersion of the jet by the drilling mud than the interference of the mud itself. Thus, in the present invention, a long chained polymer of approximately 0.1 to 2% solution may be added to the high pressure fluid in order to maintain the cohesiveness of the fluid jet. This also reduces the friction and wear on the drill string conduit, pump valves, etc.

In the second mechanism, a mechanically assisted jet system, the fluid jets are located between the cutting teeth and actually form grooves in the rock. This facilitates the formation of cracks and chips by the mechanical cutting teeth. In both systems the jet is 5–50 millimeters from the cutting plane, commonly known as the stand-off distance.

In summary, the drilling method and apparatus of the present invention increases the drilling rate of conventional drill rigs by up to five times the usual amount, while at the same time reducing the horsepower requirements of previous drilling systems by an order of magnitude.

BRIEF DESCRIPTION OF THE DRAWINGS

FIG. 2 is a sectional view of a portion of the drill string illustrating the dual conduits thereof with the high pressure conduit concentrically arranged within the lower pressure drilling mud conduit, and also illustrating the mixture of the two fluids rising in the annulus of the hole.

FIG. 4 is a close-up, cross-sectional view taken along line 4—4 of FIG. 3 illustrating the position of the fluid jet with respect to the cutting plane at the cutter/rock interface.

FIG. 5 is a close-up sectional view illustrating an alternate positioning of the fluid jet between cutting teeth.

DETAILED DESCRIPTION OF THE INVENTION

Figure 1:
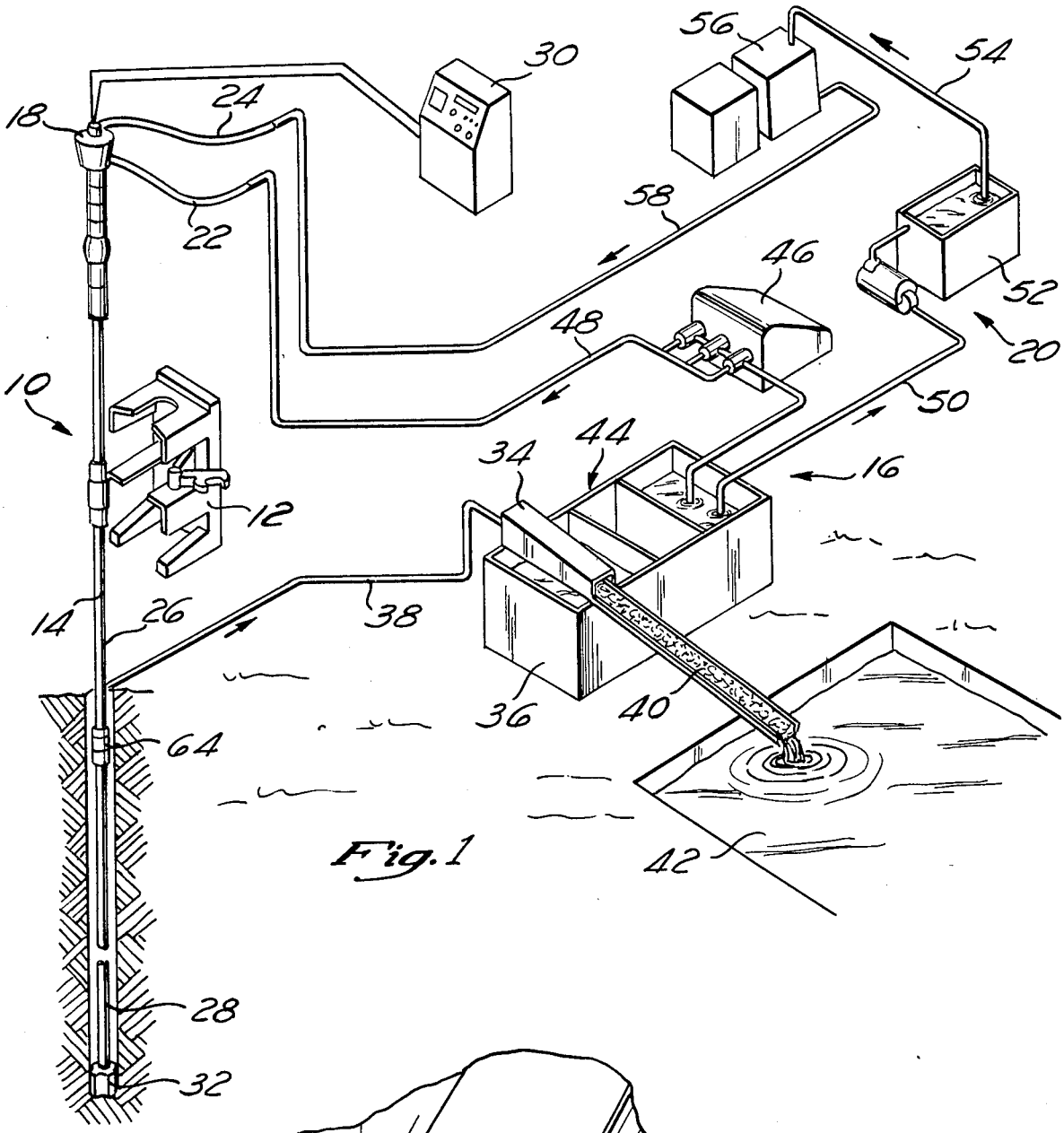
FIG. 1 is a schematic view illustrating the overall drilling method and apparatus of the present invention including the components at the well head and the drill string.

Referring to FIG. 1, there is shown a conventional drilling rig with the additional components necessitated by the method and apparatus of the combined jet/mechanical drill of the present invention. The components of the conventional drilling system include the drill string 10 (both above ground and below ground portions), the drill pipe handler 12 for attaching the individual sections of the drill pipe 14, the mud cleaning system 16 shown in the lower right hand portion of FIG. 1, and the separation system 20 located at the upper right hand portion of FIG. 1. The mud cleaning system cycles the drilling mud back into the well through the swivel 18 located at the top of the drill string 10. The separation system 20 further filters and clarifies the drilling mud so that it serves as the high pressure fluid for the jet drill.

The above ground portions of the drill string 10 include the swivel 18, as mentioned above, which permits the drill string to rotate while passing drilling fluid through the conduit of the drill pipe 14. In the present invention, a conventional swivel has been modified to include a dual rotary hose system for the injection of both the lower pressure drilling mud through one hose 22 and the high pressure jet drill fluid through a second hose 24.

The drill string 10 also includes a normal kelly section 26 for imparting rotation to the drill string 10 and a series of inter-connected drill pipe 14. The drill pipe of the present invention has been modified, as will be explained in more detail in connection with FIG. 2, to comprise a dual conduit system. Individual sections of the drill pipe are interconnected at tool joints 64, only one of which is illustrated in FIGS. 1 and 2. As with conventional drilling rigs, the below ground portion of the drill string 10 includes a weighted drill collar 28 which provides gravitational weight acting on the drill bit and a MWD (measurement while drilling) collar (not shown) which gathers vital information at the bottom of the well and transmits it up through the hole to a monitor 30. Finally, at the bottom of the hole, the drill bit 32 is attached to the end of the drill string 10. The drill bit of the present invention is described in more detail in connection with FIGS. 3–5.

A conventional mud cleaning system 16 as shown in FIG. 1 includes a solids/fluid separator 34 (sometimes referred to as a "shale shaker") located above a tank 36. The drilling mud is pumped from the well through a conduit 38 to the shaker 34. The cuttings and other major solids 40 which are contained in the drilling mud as it emerges from the hole are dumped into a cuttings pit 42. The drilling mud may or may not receive a secondary treatment 44 before being pumped back into the well. The amount and types of mud treatment depend on the individual drilling operation, geographic location, type of drilling mud, and a number of other factors. Typically, however, the mud may be passed through mechanical or vacuum degasing equipment and then through a series of hydrocyclones which remove successively finer solid components from the mud stream. Such de-sanding and de-silting cyclones can remove virtually all material greater than 40 microns and about 50% of the material greater than 15–20 microns. De-silting cyclones frequently remove the barite in weighted drilling muds and other additives which then must be replenished before the mud is ready to be pumped back into the well. Furthermore, sufficient additives must be added to the mud so that it is slightly concentrated as it goes back down the well.

At this point, the drilling mud is pumped by means of pumps 46 to the normal pressure of 3,000–5,000 psi through a conduit 48 back to the low-pressure rotary hose 22 of the swivel 18. The drilling mud is slightly concentrated as it re-enters the well so that when it mixes with the high pressure fluid at the bottom of the well it will have the proper concentration to perform its usual work of bit cooling, cuttings removal, and hole maintenance.

Still referring to FIG. 1, the separation system 20 of the present invention provides the high pressure fluid for the jet assisted drilling. Unlike drilling mud, the high pressure fluid may need to be of higher clarity than the mud since suspended solids could cause serious erosion and damage to pumps and other exposed equipment. In this system a portion of the drilling mud stream, about 10–25%, is drawn through a conduit 50 to a decanting centrifuge 52 which removes fine colloidal material from the drilling mud. Such centrifuges can remove material in the 3–5 micron range to provide a clarified fluid for pressurization purposes. Further clarification involves the use of gravity sedimentation techniques (not shown), including the use of thickeners, clarifiers and flocculating agents to neutralize the surface charges on the colloidal particles. The clarified liquid may be distilled, if necessary, utilizing waste heat from the drilling rig power source and then passed through ultra filtration devices or used directly as the fluid source for the high pressure pumps. The appropriateness of further treatment would be considered separately for each type of mud system and would depend on the adequacy of the solids control system available in the mud cleaning system.

Preferably, the high pressure liquid would contain particles only 0.015 inches or less and would be not any larger than one half the diameter of the jet nozzles (shown in FIGS. 4 and 5). The clarified fluid is then conducted through a conduit 54 to a conventional intensifier 56 which pressurizes the fluid to at least 20,000 psi at a flow rate of 25–75 gallons per minute. At these levels, only about 200–900 hp is required in the intensifier 56 or the pumping system. The pressurized fluid is then passed through a high pressure conduit 58 to the high pressure rotary hose 24 of the swivel 18.

Thus, it can be seen that the method and apparatus of the present invention contemplates a closed system in which two fluids are continuously circulated, being separated, mixed and separated again.

Referring to FIG. 2 there is shown a section of the drill pipe 14 located within the hole and just below the surface of the ground. As discussed above, the drill pipe is concentric, with the high pressure conduit 60 containing the jet drill fluid located within the outer conduit 62 which conducts the concentrated drilling mud to the bottom of the hole. This configuration promotes the safety of the present invention by locating the high pressure conduit 60 within the drill pipe 14. Two sections of the drill pipe 14*a* and 14*b* are joined at a tool joint 64 by a threaded connection. At this location, the joined portions 60*a* and 60*b* of the high pressure conduit are connected by a stab joint 66 connection and high pressure seals 68.

The arrows within the drill pipe 14 indicate that the flow of fluid therein is downward. Also shown in FIG. 2, as indicated by the arrows, is the drilling mud of normal concentration rising in the annulus 70 of the hole after the concentrated drilling mud in conduit 62 has mixed with the high pressure fluid in conduit 60 at the bottom. The mud is pumped to the mud cleaning and separation systems 16 and 20, respectively, (shown in FIG. 1) through a conduit 38 at the surface.

Figure 3:
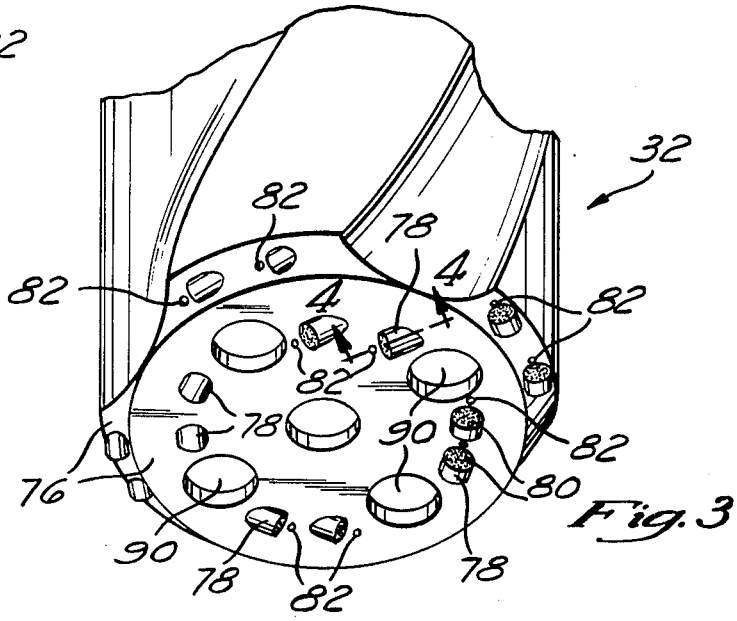
FIG. 3 is a perspective view of a conventional drag bit which has been modified to receive jet nozzles at the cutting plane of each tooth.

FIG. 3 illustrates a conventional drag bit 32 which has been modified to receive fluid jet nozzles to provide a jet assisted mechanical drill; although the principles of the present invention can also be utilized with other types of drilling bits. The bit 32 is located at the end of the drill string, as shown in FIG. 1. The cutting surface 76 of the drag bit 32 contains a number of strategically located cutting teeth 78, each having a coated, inclined cutting surface 80 manufactured from a very hard material, such as polycrystalline diamond compact (PDC). As the bit 32 rotates, these teeth 78 bite and cut into the formation. The fluid jet nozzles 82 are located immediately adjacent the cutting plane 80 of the teeth 78, shown in more detail in FIG. 4, to provide a jet assisted mechanical drill. Also, in the cutting surface 76 of the drag bit 32 is found a number of large holes 90 where the concentrated drilling mud exits. The high pressure conduit 60 is manifolded at the bit 32 to the openings 82 which form the fluid jets. Likewise, the low pressure conduit 62 is manifolded to the holes 90. Because of the rotary action of the drill bit 32 and the respective pressures of the high pressure fluid and the drilling mud itself, the fluid and the mud mix instantaneously at the bottom of the well in order to provide a drilling mud of normal concentration.

FIG. 4 illustrates the interaction of the high pressure fluid jet stream and a cutting tooth 78 on the drag bit 32 of the jet assisted mechanical drill. The tooth 78 is shown having a standard mounting in a recess of the cutting surface 76 of the drag bit 32 and is provided with a PDC cutting plane 80. The jet nozzle 82 is located so that the fluid jet (indicated by arrow 94) is parallel to the cutting surface 76 and aimed at the cutter/rock interface 96. In this embodiment, the cutter 78 opens a crack or deformation in the formation which is then propagated by the fluid jet 94. Cuttings and splashback of the jet 94 are away from the cutter surface 76 to minimize erosion and wear on the cutter surface 80. The jet 94 may be located anywhere from 0.5–3 millimeters in front of and parallel with the cutting plane 80 and approximately 5 to 50 millimeters from the target which is the cutter/rock interface 96. In addition to cleaning the cuttings and dirt from the interface area, the fluid jet 94 also cools the cutting plane 80 and the tooth 78 in order to vastly increase the drilling rate and life of the bit 32. Preferably, the fluid contains a long chain polymer in order to maintain the integrity of the jet 94 in its submerged conditions.

FIG. 5 illustrates an alternate arrangement for the fluid jets 94 which are between a pair of cutting teeth 78. In this configuration, a mechanically assisted jet drill, the jets 94 actually form grooves 98 in the rock which facilitate the formation of cracks and chips by the mechanical cutting teeth 78. In this embodiment, as in that of FIG. 4, the jets preferably are about 5 to 50 millimeters from the target. Although the jet locations shown in FIGS. 4 and 5 are preferred, other locations can also accomplish the advantages of the present invention, namely, increased drilling rate and extended bit life.

In conclusion, it can be seen that the present invention dramatically improves the typical drilling rates by providing a high pressure fluid jet stream acting in combination with a conventional mechanical cutter. Furthermore, the fluid jet is economically provided by diverting and clarifying only a small portion of the total drilling mud stream and then combining the two fluids at the drill bit.

What is claimed is:

1. A method for improving the rate of drilling a hole in an earthen formation, comprising:

(a) conducting a first fluid down said hole to said drill;

(b) conducting a second fluid down said hole to said drill;

(c) jetting said second fluid through openings in said drill and against said formation to assist said drill in drilling, said second fluid being substantially clarified to prevent the clogging of said openings;

(d) mixing said first and second fluids substantially at the bottom of said hole;

(e) conducting the mixture of fluids back up the hole to the surface;

(f) segregating a portion of said fluid mixture to provide said second fluid, the remainder of said mixture serving as said first fluid;

(g) re-conducting said second fluid down said hole; and (h) re-conducting said first fluid down said hole.

2. The method of claim 1 further comprising the step of clarifying said portion of said fluid mixture before conducting said second fluid down said hole.

3. The method of claim 1 further comprising the step of removing solids from said fluid mixture before segregating a portion of said mixture.

4. The method of claim 1 further comprising the step of concentrating said first fluid with additives before conducting said first fluid down said hole.

5. The method of claim 1 further comprising the step of conducting separately but concurrently said first and second fluids down said hole.

6. The method of claim 1 wherein said jetting step comprises;

a. pressurizing said second fluid to a pressure greater than said first fluid; and b. passing said pressurized second fluid through a pressure drop to form a fluid jet.

7. The method of claim 6 further comprising the step of locating said higher pressure second fluid within said lower pressure first fluid while separately conducting said first and second fluids down said hole.

8. A method for drilling a hole in an earthen formation, comprising:

(a) conducting a first fluid down said hole;

(b) separately conducting a second fluid down said hole;

(c) mixing said first and second fluids within said hole;

(d) conducting said fluid mixture back up the hole to the surface;
(e) segregating and substantially clarifying a portion of said fluid mixture;
(f) pressurizing the remainder of said fluid mixture;
(g) pressurizing said segregated portion of said fluid mixture to a pressure greater than said fluid mixture; and
(h) separately re-conducting said pressurized fluids down said hole as said first and second fluids.

9. The method of claim 8 further comprising the step of pressurizing said segregated fluid portion to a level at least two times greater than the pressure of said fluid mixture.

10. A method for circulating drilling fluid in a drilling fluid circuit in connection with the drilling of a hole in an earthen formation, comprising:
a. circulating a first, substantially clarified fluid stream at a lower flow rate;
b. circulating a second fluid stream at a higher flow rate;
c. mixing said first and second fluid streams;
d. separating said first and second fluid streams from one another; and
e. re-establishing the respective flow rates of said first and second fluid streams.

11. The method of claim 10 further comprising the step of pressurizing said first fluid stream to a level which is greater than the pressure of said second fluid.

12. A system for drilling a hole in an earthen formation, comprising:
a. a drill bit;
b. a first substantially closed fluid circuit for circulating a drilling fluid stream;
c. a second substantially closed fluid circuit for circulating a second fluid stream;
d. at least one jet in said second fluid circuit adjacent said drill bit for directing a jet of said second fluid adjacent said drill bit;
e. said second fluid jet stream and said drilling fluid stream being effluent at said drill bit to form a common stream;
f. means for segregating a portion of said common stream; and
g. means for pressurizing said portion to a level greater than said common stream, said pressurized portion forming said second fluid jet stream.

13. The system of claim 12 further comprising means in said second circuit for removing particles from said second fluid stream having a diameter larger than about one-half the diameter of said jet.

14. The system of claim 12 wherein said segregated portion comprises less than 50% of said common stream.

15. The system of claim 12 further comprising a first conduit for conducting said drilling fluid stream to said drill bit, a second conduit for conducting said fluid jet stream to said drill bit, said second conduit being located within said first conduit.

16. The system of claim 12 wherein said segregated portion is pressurized to a pressure capable of assisting the mechanical action of a drill bit.

17. The system of claim 12 wherein the flow rate of said fluid jet stream is 5 to 50 percent of the flow rate of said drilling fluid stream.

18. A method for conducting fluid in connection with the drilling of a hole in an earthen formation, comprising:
(a) highly pressurizing a first fluid stream at the surface of said formation in order to avoid the adverse effect of extreme downhole conditions on the pressurizing means;
(b) conducting said first highly pressurized fluid stream down said hole;
(c) directing said first highly pressurized fluid stream against said formation to assist in drilling said hole;
(e) conducting a second fluid stream down said hole to provide well control in drilling said hole, said second fluid stream having a higher volume and lower pressure than that of said first fluid stream; and
(f) mixing said first and second fluid streams to remove cuttings and other solids from the hole.

19. The method of claim 18 wherein said first and second fluid streams are separated from one another from the surface of the formation to substantially the bottom of the hole where they are mixed together.

20. The method of claim 18 wherein said first highly pressurized fluid stream is directed against said formation through openings near the bottom of the hole, further comprising the step of:
(a) removing from said first highly pressurized fluid stream substantially all particles having a diameter in the range of 15–40 microns in order to reduce wear and tear on said pressurizing means and to avoid clogging said openings near the bottom of said hole, thereby reducing the horsepower requirements of the pressurizing means in drilling said hole.

21. The method of claim 18 wherein the volumetric flow rate of said first fluid stream is in the range of about 10 to 25 percent of the volumetric flow rate of said second fluid stream.

22. The method of claim 18 wherein said horsepower requirements for drilling said hole are in the range of about 200 to 900 horsepower.

23. The method of claim 18 wherein said second fluid stream is concentrated with drilling mud additives, further comprising the step of adjusting said concentration such that the mixture of both fluid streams produces the proper concentration to accomplish the normal purposes of drilling mud.

* * * * *

REEXAMINATION CERTIFICATE (1340th)

United States Patent [19]

Reichman

[11] B1 4,624,327

[45] Certificate Issued Aug. 21, 1990

[54] METHOD FOR COMBINED JET AND MECHANICAL DRILLING

[75] Inventor: James R. Reichman, Issaquah, Wash.

[73] Assignee: Flowdril Corporation, Kent, Wash.

Reexamination Request:
No. 90/001,728, Mar. 13, 1989

Reexamination Certificate for:

| | |
|---|---|
| Patent No.: | **4,624,327** |
| Issued: | **Nov. 25, 1986** |
| Appl. No.: | **661,368** |
| Filed: | **Oct. 16, 1984** |

[51] Int. Cl.[5] ..... E21B 7/18
[52] U.S. Cl. ..... 175/67; 175/70
[58] Field of Search ..... 175/65, 66, 67, 70, 175/38, 207, 209, 215, 217, 218; 299/16, 17

[56] References Cited

U.S. PATENT DOCUMENTS

| | | | |
|---|---|---|---|
| 1,338,460 | 4/1920 | Morrison . | |
| 1,512,140 | 10/1924 | Schaub . | |
| 1,585,969 | 5/1926 | Ferguson . | |
| 2,258,001 | 10/1941 | Chamberlain | 255/1 |
| 2,720,381 | 10/1955 | Quick | 255/1.8 |
| 2,941,783 | 6/1960 | Stinson | 255/1 |
| 3,112,800 | 12/1963 | Bobo | 175/67 |
| 3,208,539 | 9/1965 | Henderson | 175/215 |
| 3,375,886 | 4/1968 | Goodwin et al. | 175/66 |
| 3,419,092 | 12/1968 | Elenburg | 175/69 |
| 3,508,621 | 4/1970 | Gaylord et al. | 175/67 |
| 3,839,875 | 10/1974 | Matsushita | 61/53.74 |
| 3,851,490 | 12/1974 | Matsushita | 61/53.74 |
| 4,359,115 | 11/1982 | Cagnioncle | 175/393 |
| 4,401,345 | 8/1983 | Archibald | 299/64 |
| 4,458,766 | 7/1984 | Siegel | 175/25 |
| 4,534,427 | 8/1985 | Wang et al. | 175/67 |

FOREIGN PATENT DOCUMENTS

| | | | |
|---|---|---|---|
| 933146 | 9/1973 | Canada | 255/8 |

OTHER PUBLICATIONS

"Development of High-Pressure Abrasive-Jet Drilling", John C. Fair, SPE, Gulf Research and Development Co., Aug. 1981.

"Hydro-Blast Mining Shoots Ahead", A. B. Fly, Mining Engineering, Mar. 1969.

"Research and Development of a High-Pressure Waterjet Coring Device for Geothermal Exploration and Drilling" Final Report-01/78 by James M. Reichman—Flow Industries, Inc., Kent, Washington.

"Evaluation of High Pressure Drilling Fluid Supply Systems" Contractor Report by Michael C. McDonald et al., Sandia National Labs., Albuquerque, NM, Oct. 1981.

"Advanced Drilling Techniques" by William C. Maurer, Petroleum Publishing Co., Tulsa, OK-1980, pp. 19-27.

"High Pressure Jet Assisted Mechanical Drills" Advanced Drilling Techniques, pp. 347-405, Petroleum Publishing Co., Tulsa, OK-1980.

*Primary Examiner*—Thomas R. Hannon

[57] ABSTRACT

A method and apparatus for drilling combines the advantages of a high pressure fluid jet with a mechanical drill bit without the high horsepower requirements and associated equipment wear of prior jet drilling systems. A two fluid system is contemplated in which only a small portion of the drilling mud stream is clarified and pumped under high pressure to a number of jet nozzles located on the drill bit face. The high pressure fluid and concentrated drilling mud are conducted separately down the hole by a dual, concentric drill pipe. The power and equipment requirements of such a two fluid system are practical and economic because of the low flow rate and non-abrasiveness of the high pressure fluid when compared to conventional drilling fluids. The high pressure fluid combines with the concentrated drilling mud at the drill bit in order to accomplish the normal purposes of the drilling mud. The returned fluid is processed at the surface separating out solids, mud, and the mud to be clarified. This forms a closed system cycle. The fluid jets are strategically arranged with respect to the cutting teeth on the drill bit in order to minimize bit wear and to increase the drilling rate by up to five times. Two systems are disclosed. The first is a jet assisted mechanical system in which the jets are directed at the earthen formation at the cutting surface/rock interface. The second is a mechanically assisted jet system in which the jets are located between the cutting teeth.

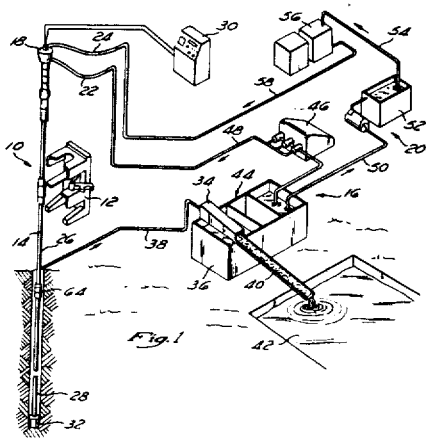

Fig. 1

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2 and 3 are cancelled.

Claims 1, 8, 10, 12, and 18 are determined to be patentable as amended.

Claims 4–7, 9, 11, 13–17 and 19–23, dependent on an amended claim, are determined to be patentable.

1. A method for improving the rate of drilling a hole in an earthen formation, comprising:

(a) conducting a first fluid down said hole to said drill;

(b) conducting a second fluid down said hole to said drill;

(c) jetting said second fluid through openings in said drill and against said formation to assist said drill in drilling, said second fluid being substantially clarified to prevent the clogging of said openings;

(d) mixing said first and second fluids substantially at the bottom of said hole;

(e) conducting the mixture of fluids back up the hole to the surface;

*(f) cleaning the mixture of fluids to remove solids therefrom;*

[(f)] *(g)* segregating a portion of [said] *the* fluid mixture *with the solids removed* to provide said second fluid, the [remainder] *remaining portion* of said mixture serving as said first fluid;

*(h) further cleaning said segregated portion by removing small particles therefrom to substantially clarify said second fluid to prevent clogging of the openings in said drill;*

[(g)] *(i)* re-conducting said *substantially clarified* second fluid down said hole; and

[(h)] *(j)* re-conducting said first fluid down said hole.

8. A method for drilling a hole in an earthen formation, comprising:

(a) conducting a first fluid down said hole;

(b) separately conducting a second fluid down said hole;

(c) mixing said first and second fluids within said hole;

(d) conducting said fluid mixture back up the hole to the surface *and cleaning said fluid mixture to remove solids therefrom;*

(e) segregating and [substantially clarifying] *further cleaning* a portion of [said] *the cleaned* fluid mixture *to provide a substantially clarified segregated portion;*

(f) pressurizing the remainder of said fluid mixture;

(g) pressurizing said segregated portion of said fluid mixture to a pressure greater than *the remainder of* said fluid mixture; and (h) separately re-conducting said pressurized fluids down said hole as said first and second fluids.

10. A method for circulating drilling fluid in a drilling fluid circuit in connection with the drilling of a hole in an earthen formation, comprising:

(a) circulating a first, substantially clarified fluid stream *through said drilling fluid circuit* at a lower flow rate;

(b) circulating a second fluid stream *through said drilling fluid circuit* at a higher flow rate;

(c) mixing said first and second fluid streams;

(d) separating said first and second fluid streams from one another; [and]

*(e) cleaning said first and second fluid streams, said cleaning step comprising the step of cleaning said first fluid stream more than said second fluid stream to provide said substantially clarified fluid stream; and*

[(e)] *(f)* re-establishing the respective flow rates of said first and second fluid streams *to provide continued circulation of said fluid streams in said drilling fluid circuit.*

12. A system for drilling a hole in an earthen formation, comprising:

(a) a drill bit;

(b) a first substantially closed fluid circuit for circulating a drilling fluid stream;

(c) a second substantially closed fluid circuit for circulating a substantially clarified second fluid stream;

(d) at least one jet in said second fluid circuit adjacent said drill bit for directing a jet of said second fluid adjacent said drill bit;

(e) said second fluid jet stream and said drilling fluid stream being effluent at said drill bit to form a common stream;

*(f) means for cleaning said common stream;*

[(f)] *(g)* means for segregating a portion of said common stream; [and]

*(h) means for further cleaning said portion of said common stream to provide said substantially clarified second fluid stream, said means for further cleaning connected to said means for segregating such that said means for further cleaning receives only said portion of said common stream*; and

[(g)] *(i)* means for pressurizing said portion to a level greater than said common stream, said pressurized portion forming said second fluid jet stream.

18. A method for conducting fluid in connection with the drilling of a hole in an earthen formation, comprising:

(a) substantially clarifying a first fluid stream;

(b) highly pressurizing said first fluid stream at the surface of said formation in order to avoid the adverse effect of extreme downhole conditions on the pressurizing means;

(c) conducting said first highly pressurized fluid stream down said hole;

(d) directing said first highly pressurized fluid stream against said formation to assist in drilling said hole;

(e) conducting a second fluid stream down said hole to provide a well control in drilling said hole, said second fluid stream having a higher volume and lower pressure than that of said first fluid stream; [and]

(f) mixing said first and second fluid streams to remove cuttings and other solids from the hole;

*(g) cleaning the mixed first and second fluid streams; and*

*(h) repeating steps (a)–(g) using the cleaned first and second fluid streams.*

* * * * *